US009656800B2

(12) United States Patent
Donahue et al.

(10) Patent No.: US 9,656,800 B2
(45) Date of Patent: May 23, 2017

(54) SUBSEA FLUID STORAGE SYSTEM

(71) Applicant: Oceaneering International, Inc., Houston, TX (US)

(72) Inventors: Keith Donahue, Annapolis, MD (US); Arthur Martin Kirkby, III, Baltimore, MD (US); David Garcia, Abingdon, MD (US); Don Hay, Houston, TX (US); Jake Hennig, Cypress, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 14/340,383

(22) Filed: Jul. 24, 2014

(65) Prior Publication Data

US 2016/0023843 A1 Jan. 28, 2016

(51) Int. Cl.
*B65D 88/78* (2006.01)

(52) U.S. Cl.
CPC ..... *B65D 88/78* (2013.01)

(58) Field of Classification Search
CPC ..... B65D 88/78; B65G 5/00; B63B 35/44
See application file for complete search history.

(56) References Cited

U.S. PATENT DOCUMENTS 2,947,437 A * 8/1960 Greer ..... B65D 88/78 220/216
3,695,047 A * 10/1972 Pogonowski ..... B65D 88/78 114/257
4,480,569 A * 11/1984 van der Veen ..... E02F 5/28 114/244
4,662,386 A 5/1987 Pedersen
5,082,138 A * 1/1992 McGarvey ..... B65D 90/501 220/560.01
5,234,191 A * 8/1993 Bambacigno ..... B28B 7/22 249/219.1
5,235,928 A 8/1993 Shank, Jr.
7,270,907 B2 * 9/2007 Becerra ..... H01M 8/02 220/530
7,500,442 B1 3/2009 Schanz
7,841,289 B1 * 11/2010 Schanz ..... B63B 25/08 114/256

(Continued)

OTHER PUBLICATIONS

International search report and written opinion of the international searching authority for co-pending PCT application No. PCT/US2015/041812 mailed Oct. 6, 2015.

(Continued)

*Primary Examiner* — Benjamin Fiorello
(74) *Attorney, Agent, or Firm* — Baker & McKenzie LLP

(57) ABSTRACT

The present disclosure relates, according to some embodiments, to subsea fluid storage systems that may automatically and/or continuously compensate for subsea pressure changes. A subsea fluid storage unit with passive pressure compensation may comprise a vessel and a deformable bladder disposed within the vessel. A vessel may comprise a top port, a bottom port, and an internal vessel volume. A deformable bladder may comprise a first end and a second end. A second end may comprise a bladder opening that may be fluidically connected to a top port or a bottom port of a vessel. A deformable bladder may define an internal bladder volume that may be suitable for storage of fluids and/or chemicals.

27 Claims, 14 Drawing Sheets

(56) References Cited

U.S. PATENT DOCUMENTS

| | | | | |
|---|---|---|---|---|
| 2002/0009330 | A1* | 1/2002 | Northcott | B65D 88/78 405/53 |
| 2002/0148401 | A1* | 10/2002 | Eagles | B63B 35/285 114/256 |
| 2006/0159523 | A1* | 7/2006 | Dixon | B63B 3/13 405/162 |
| 2008/0199257 | A1* | 8/2008 | Hilditch | E21B 43/013 405/209 |
| 2010/0089126 | A1* | 4/2010 | Sweeney | B63C 11/42 73/40 |
| 2011/0150576 | A1* | 6/2011 | Alliot | F16L 1/16 405/169 |
| 2011/0158824 | A1* | 6/2011 | Wright | B01D 19/0042 417/53 |
| 2011/0215510 | A1* | 9/2011 | Eriksen | F16J 12/00 264/604 |
| 2012/0085276 | A1 | 4/2012 | Openshaw et al. | |
| 2014/0133922 | A1 | 5/2014 | Hantz | |

OTHER PUBLICATIONS

International Preliminary Report on Patentability of the International Searching Authority for co-pending PCT application No. PCT/2015/041812, mailed Jan. 24, 2017.

* cited by examiner

SUBSEA FLUID STORAGE SYSTEM

FIELD OF THE DISCLOSURE

The present disclosure relates, in some embodiments, to subsea fluid storage units, subsea fluid storage modules, and subsea fluid storage facilities with passive pressure compensation for subsea storage (e.g., long-term storage) of fluids.

BACKGROUND OF THE DISCLOSURE

Subsea fluid storage systems may utilize lengthy umbilicals to transport a desired fluid. For example, umbilicals may transport a desired fluid from a remote chemical supply tank to a subsea well tree. In some circumstances, it may not be unusual for a remote chemical supply tank to be 20, 50, or 80 miles away from the subsea well tree. Thus, a corresponding umbilical may also be 20, 50, or 80 miles long. The extensive length that may be required for an umbilical may present various challenges or difficulties associated with the assembling, maintaining, or repairing of the umbilical. For example, umbilicals may need to withstand considerable and varying pressures within a subsea environment. The difficulty of identifying, locating, containing, and repairing leaks may increase as a function of umbilical length. Still further, the assembling, inspecting, and maintaining lengthy umbilicals may require very high costs.

Other fluid storage systems may utilize subsea storage systems. However, subsea storage systems may encounter various problems associated with assembly, maintenance, and/or repair. For example, subsea storage systems may face extensive and constantly varying pressures (e.g., as water temperature changes). Changes in subsea pressures may result in damage to subsea storage systems, requiring frequent servicing and/or repairing, and may prevent the long-term use of subsea storage systems.

SUMMARY

Accordingly, a need has arisen for improved subsea fluid storage systems that may automatically and/or continuously compensate for subsea pressure changes, and may be convenient to refill in subsea environments or retrieve to the surface.

The present disclosure relates to subsea fluid storage systems that may automatically and/or continuously compensate for subsea pressure changes. A subsea fluid storage unit with passive pressure compensation may comprise a vessel and a deformable bladder disposed within the vessel. A vessel may comprise a top port, a bottom port, and an internal vessel volume. A deformable bladder may comprise a first end and a second end. A second end may comprise a bladder opening that may be fluidically connected to a top port or a bottom port of a vessel. A deformable bladder may define an internal bladder volume that may be suitable for storage of fluids and/or chemicals.

A subsea fluid storage unit may further comprise a piston disposed within a vessel, adjacent to a first end of a bladder. A piston may behave differently depending on a density of a stored fluid. For example, a piston may be weighted, neutral, or buoyant, depending on a density of a stored fluid. A position of a piston within a vessel may vary as an internal bladder volume of a bladder varies. A piston may define an upper chamber and lower chamber within a vessel.

In some embodiments, a bottom port of a vessel may be in fluid communication with an internal bladder volume, and a top port may be in fluid communication with ambient seawater. In other embodiments, a top port of a vessel may be in fluid communication with an internal bladder volume, and a bottom port may be in fluid communication with ambient seawater.

The present disclosure relates, in some embodiments, to subsea fluid storage modules. A subsea fluid storage module may comprise, for example, a subsea fluid storage unit skid and at least one subsea fluid storage unit disposed within the subsea fluid storage unit skid. A subsea fluid storage unit skid may be defined, at least in part, by a plurality of I-beam segments.

Another aspect of the present disclosure relates to subsea fluid storage facilities. In some embodiments, a subsea fluid storage facility may comprise a subsea platform, at least one subsea fluid storage unit skid disposed on a subsea platform, and at least one subsea fluid storage unit disposed within a subsea fluid storage unit skid.

Another aspect of the present disclosure relates to methods of operating a subsea fluid storage unit. A method may comprise disposing a subsea fluid storage unit in a subsea environment, and depositing a fluid within a bladder of a subsea fluid storage unit.

In some embodiments, a second end of a bladder of a subsea fluid storage unit may be fluidically connected to a top port of a vessel. A method may further comprise dispensing a fluid from a top port, whereby dispensing a fluid decreases an internal bladder volume. A method may further comprise receiving seawater from a bottom port, whereby receiving seawater expands an internal vessel volume.

In some embodiments, a second end of a bladder of a subsea fluid storage unit may be fluidically connected to a bottom port of a vessel. A method may further comprise dispensing a fluid from a bottom port, whereby dispensing a fluid decreases an internal bladder volume. A method may further comprise receiving seawater from a top port, whereby receiving seawater expands an internal vessel volume.

BRIEF DESCRIPTION OF THE DRAWINGS

Some embodiments of the disclosure may be understood by referring, in part, to the present disclosure and the accompanying drawings, wherein.

Figure 1:
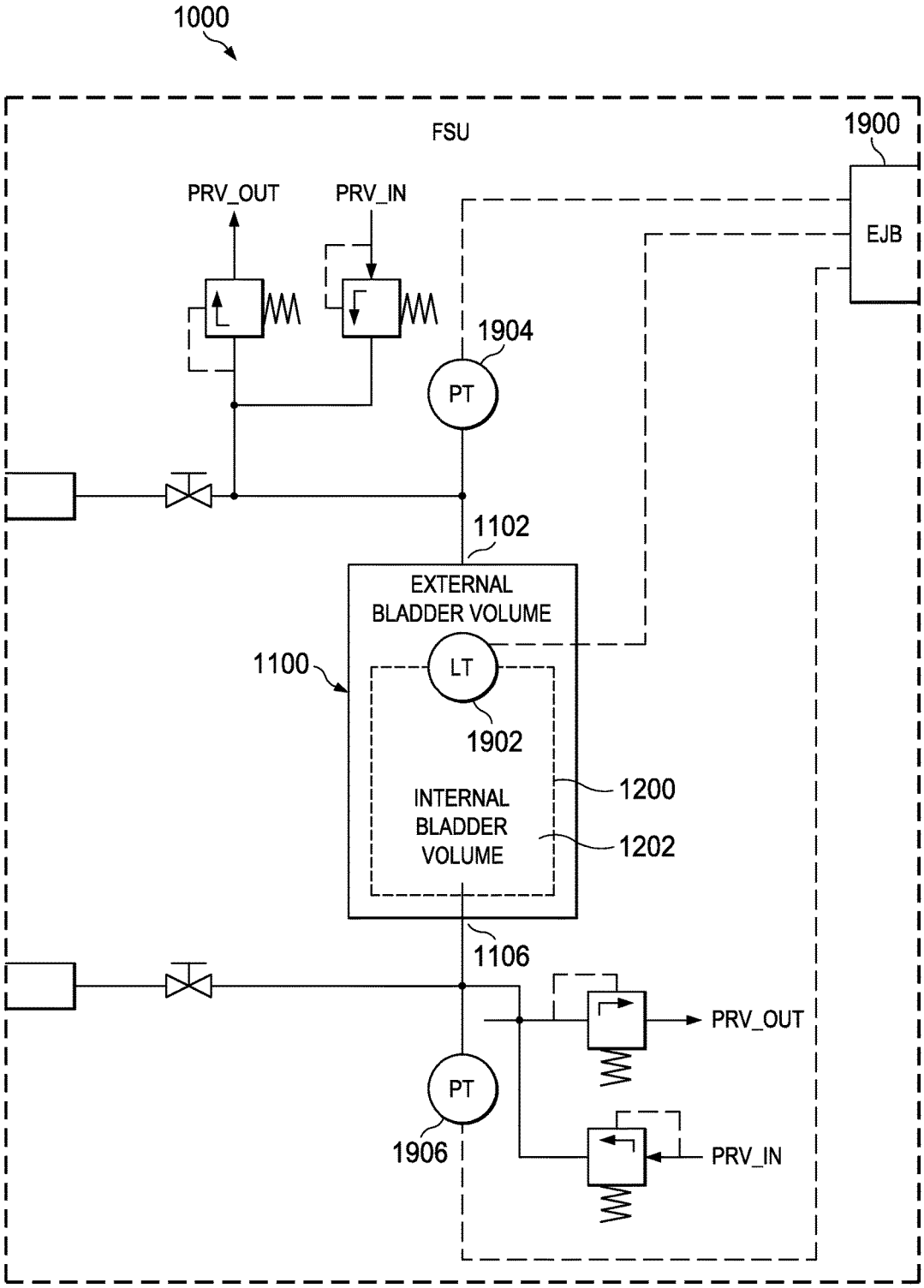
FIG. 1 illustrates a schematic for a subsea fluid storage unit according to a specific example embodiment of the disclosure.

Table 1 below includes the reference numerals used in this application. The thousands and hundreds digits correspond to the figure in which the item appears while the tens and ones digits correspond to the particular item indicated. Similar structures share matching tens and ones digits.

Figure 3A:
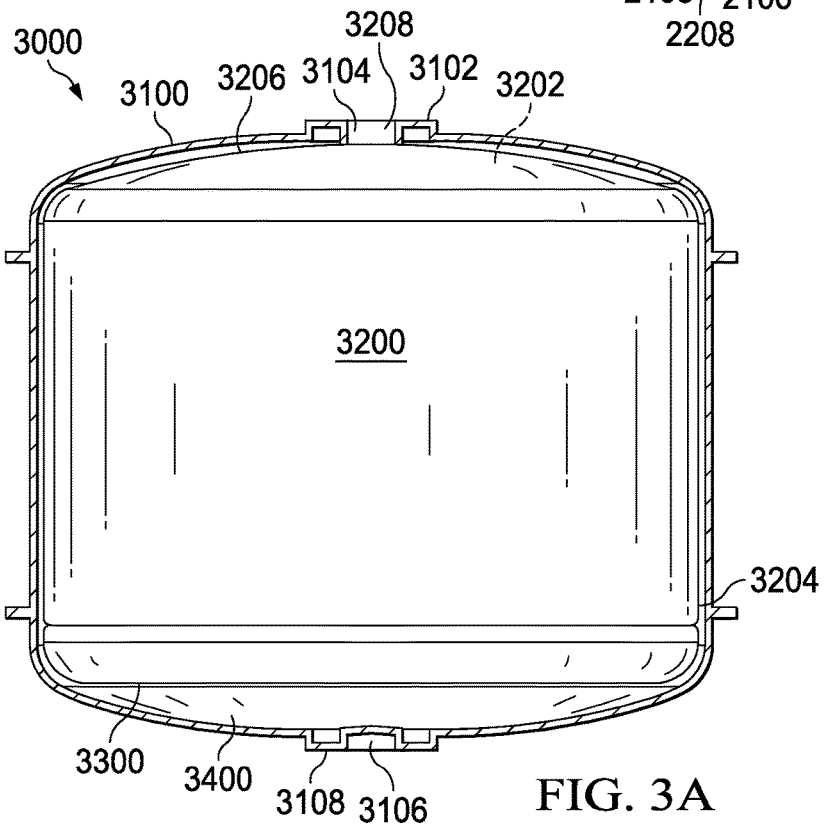
FIG. 3A illustrates a section view of a subsea fluid storage unit according to a specific example embodiment of the disclosure.
Figure 3B:
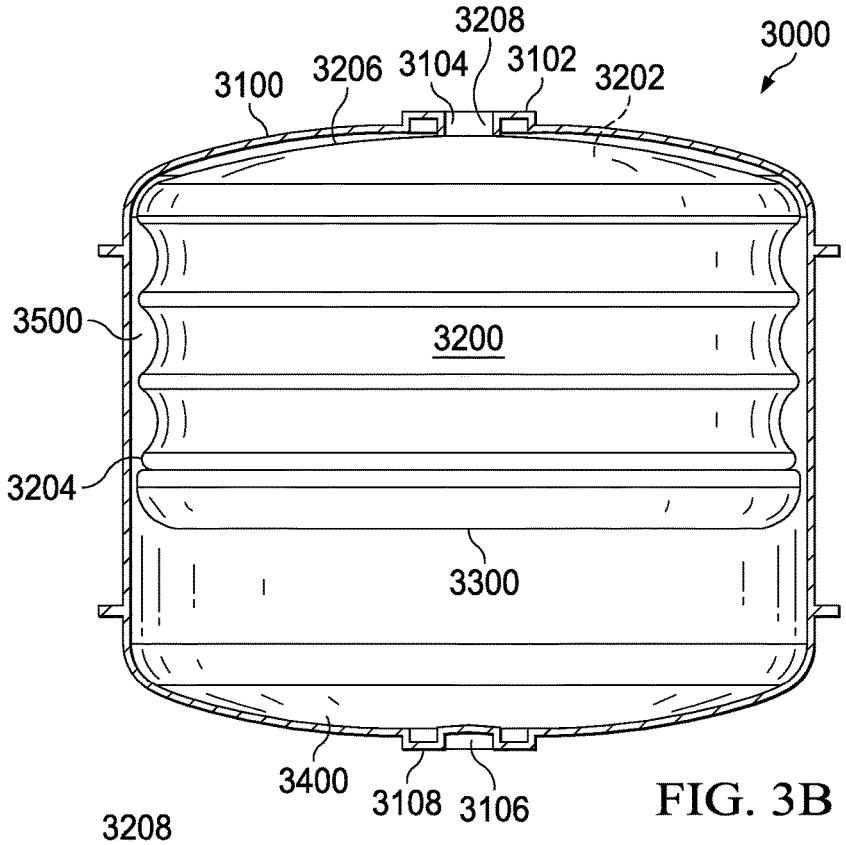
FIG. 3B illustrates a section view of a subsea fluid storage unit according to a specific example embodiment of the disclosure.
Figure 3C:
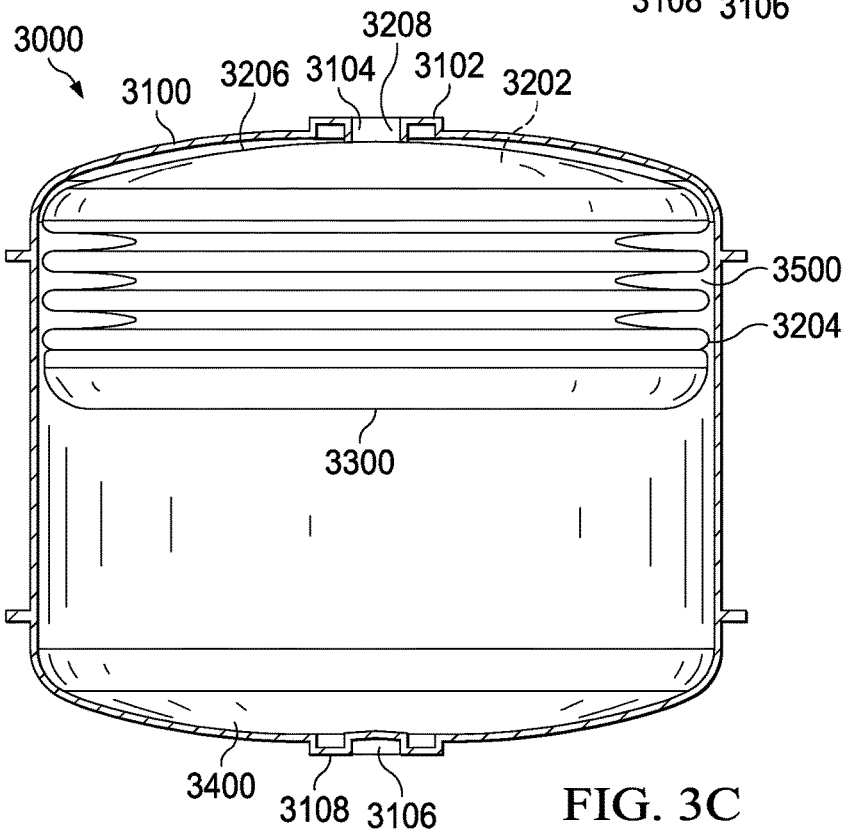
FIG. 3C illustrates a section view of a subsea fluid storage unit according to a specific example embodiment of the disclosure.
Figure 4:
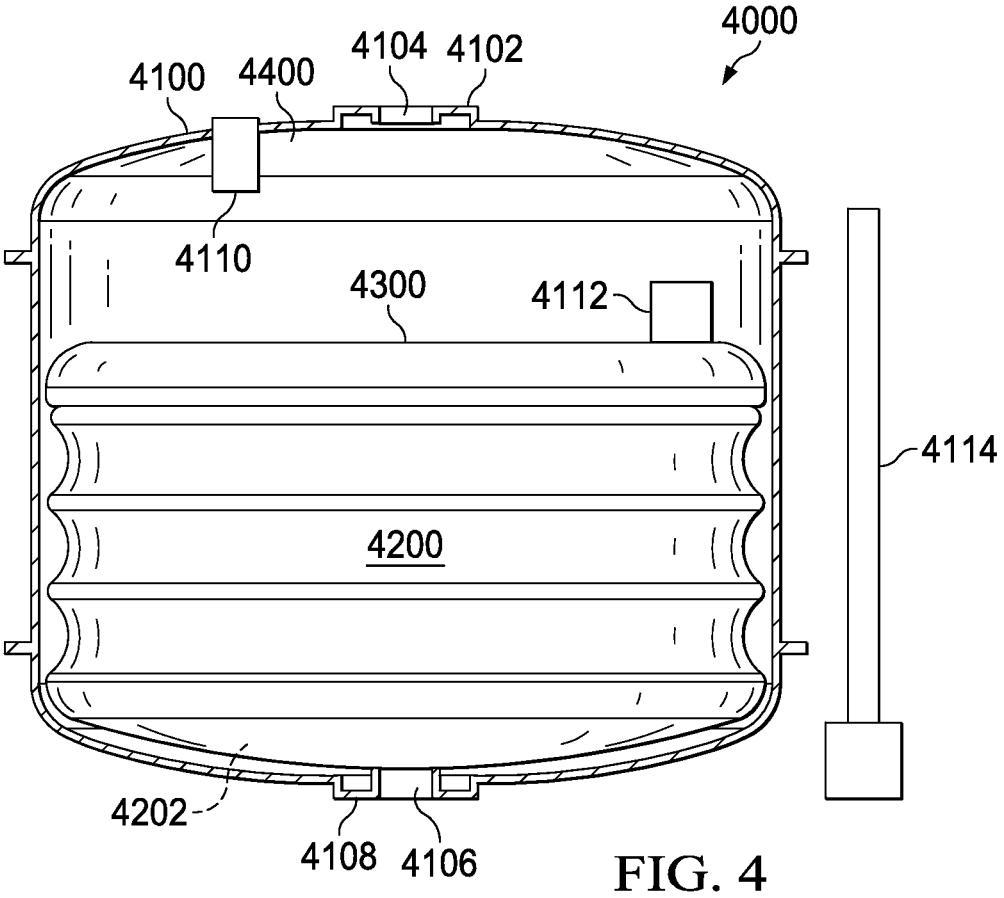
FIG. 4 illustrates a section view of a subsea fluid storage unit according to a specific example embodiment of the disclosure.

| | FIG. 1 | FIG. 2 | FIG. 3 | FIG. 4 | FIG. 5 | FIG. 6 | FIG. 7 |
|---|---|---|---|---|---|---|---|
| Subsea fluid storage unit | 1000 | 2000 | 3000 | 4000 | 5000 | 6000 | 7000 |
| Vessel | 1100 | 2100 | 3100 | 4100 | 5100 | | |
| Top port | 1102 | 2102 | 3102 | 4102 | 5102 | | |
| Top opening | | 2104 | 3104 | 4104 | | | |
| Bottom port | 1106 | 2106 | 3106 | 4106 | 5106 | | |
| Bottom opening | | 2108 | 3108 | 4108 | | | |
| Handling features | | | | | 5116 | | |
| Vent port | | | | | 5120 | | |
| Drain port | | | | | 5122 | | |
| External bladder header | | | | | 5136 | | |
| Internal bladder header | | | | | 5134 | | |
| Top isolation valve | | | | | 5130 | | |
| Bottom isolation valve | | | | | 5138 | | |
| Bottom pressure relief valves | | | | | 5128 | | |
| Top pressure relief valves | | | | | 5132 | | |
| Bladder | 1200 | 2200 | 3200 | 4200 | | | |
| Internal bladder volume | 1202 | 2202 | 3202 | 4202 | | | |
| First end | | 2204 | 3204 | | | | |
| Second end | | 2206 | 3206 | | | | |
| Bladder opening | | 2208 | 3208 | | | | |
| Piston | | 2300 | 3300 | 4300 | | | |
| External bladder volume | | 2400 | 3400 | 4400 | | | |
| Side recess volume | | 2500 | 3500 | | | | |
| Electrical junction box | 1900 | | | | 5900 | 6900 | |
| Top pressure transducer | 1904 | | | | 5904 | | |
| Bottom pressure transducer | 1906 | | | | 5906 | | |
| Level transducer | 1902 | | | | | | |
| Internal LVDT | | | | 4112 | | | |
| External LVDT | | | | 4114 | | | |
| Altimeter | | | | 4110 | | | |
| Level Sensor | | | | | 5908 | | |
| Subsea fluid storage skid | | | | | | 6600 | 7600 |
| Removable frame members | | | | | | 6602 | |
| ISO corners | | | | | | 6604 | |
| Forklift handling features | | | | | | 6606 | |
| DNV lift points | | | | | | 6608 | |
| Wiring harnesses | | | | | | 6610 | |
| Fluid manifolds | | | | | | 6612 | |
| Automated valve | | | | | | 6614 | |
| Interface panel | | | | | | 6700 | |
| Pressure gauges | | | | | | 6702 | |
| Sea water intake | | | | | | 6704 | |
| Wet mate connectors | | | | | | 6706 | |
| Hot stab interface | | | | | | 6708 | |
| Service fluid port | | | | | | 6710 | |
| ROV controlled valves | | | | | | 6712 | |
| Subsea platform | | | | | | | 7800 |

Figure 6A:
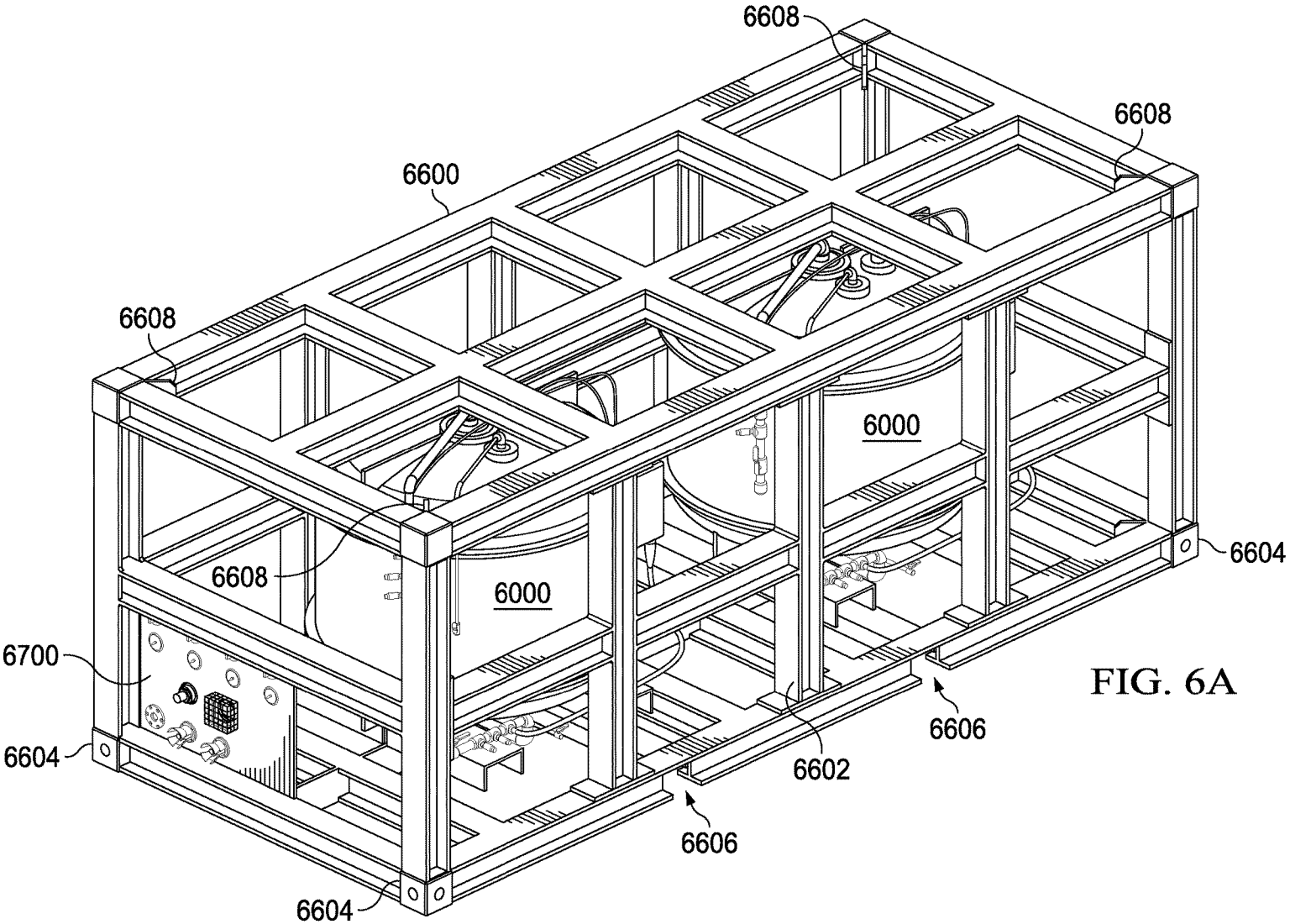
Figure 6B:
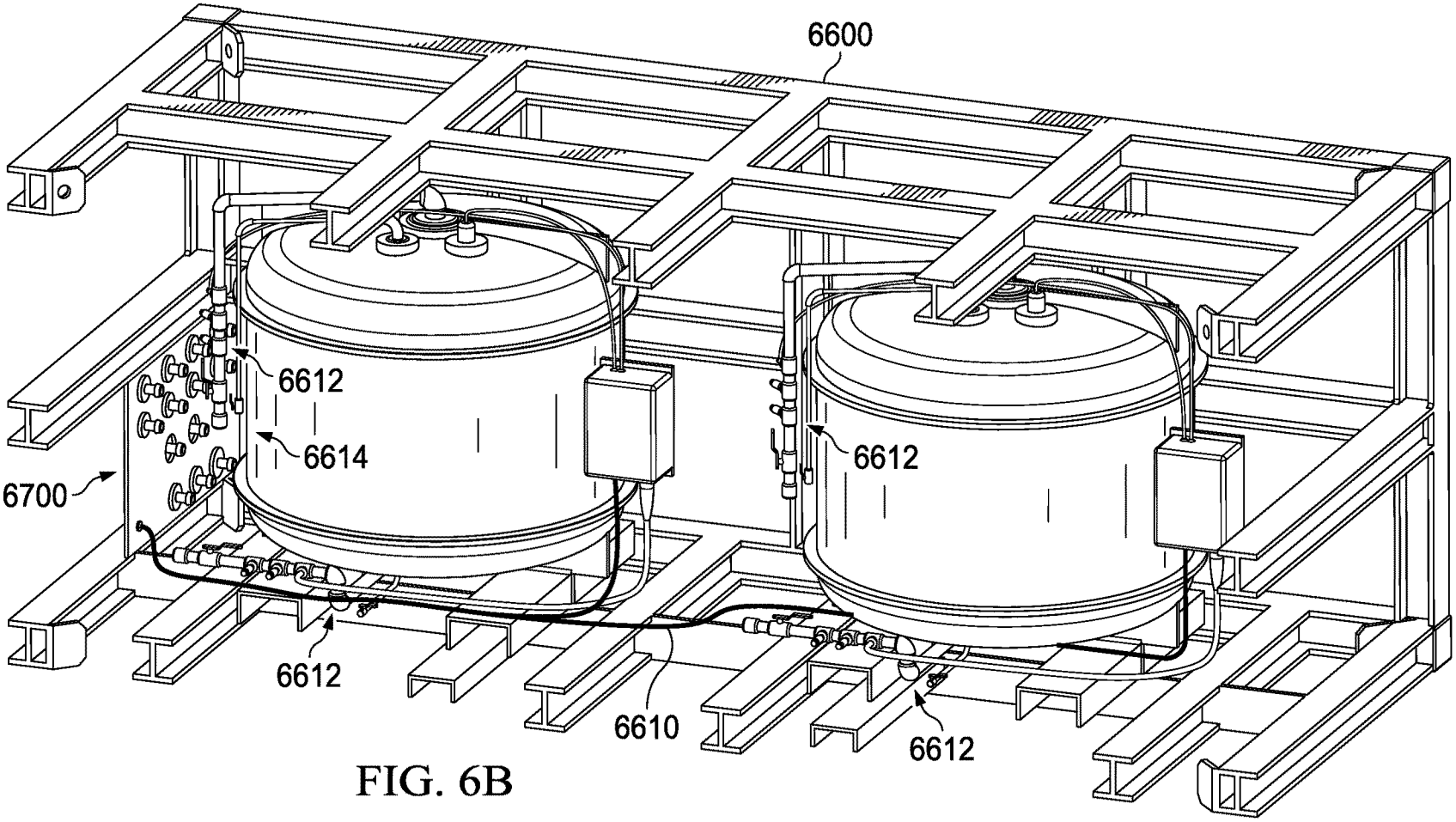
Figure 6C:
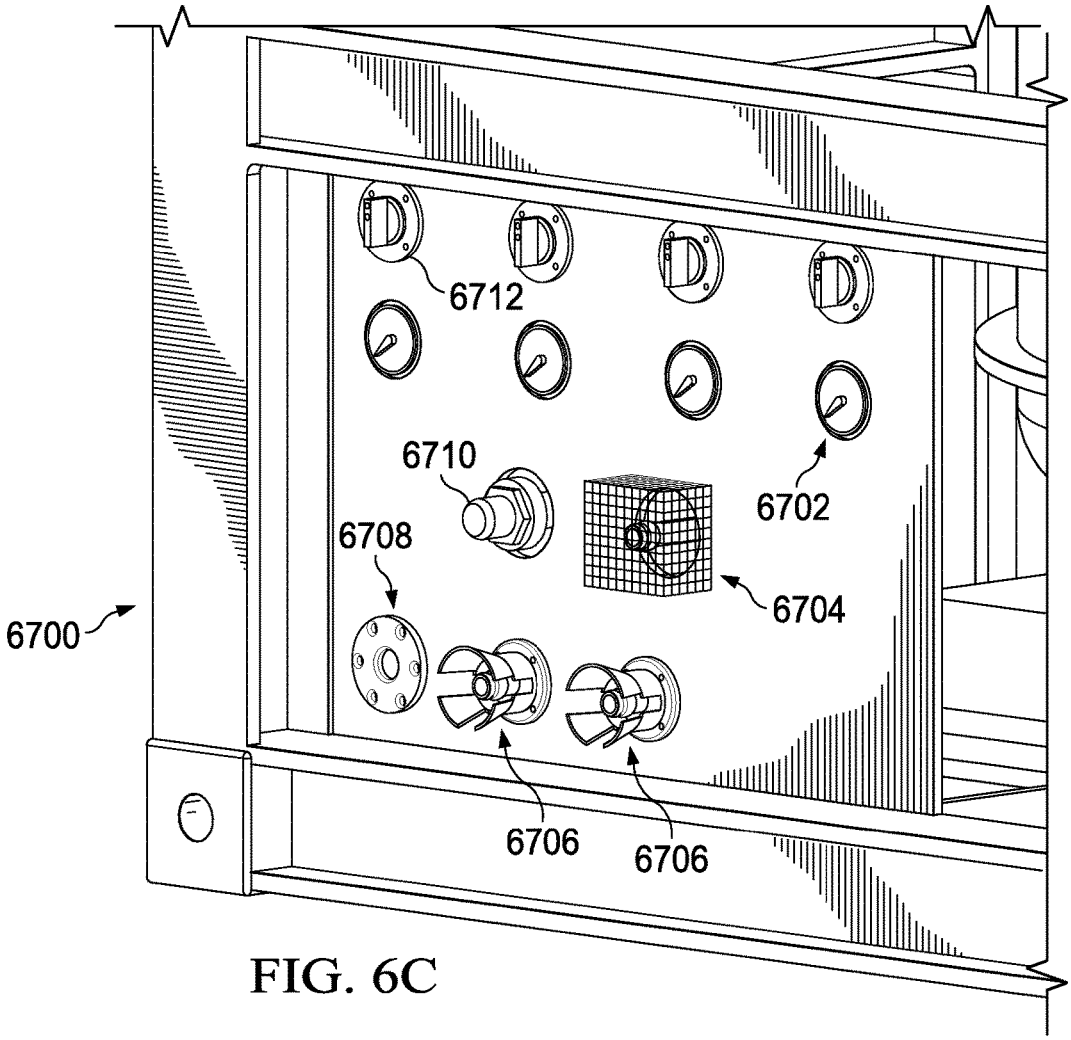
Figure 6D:
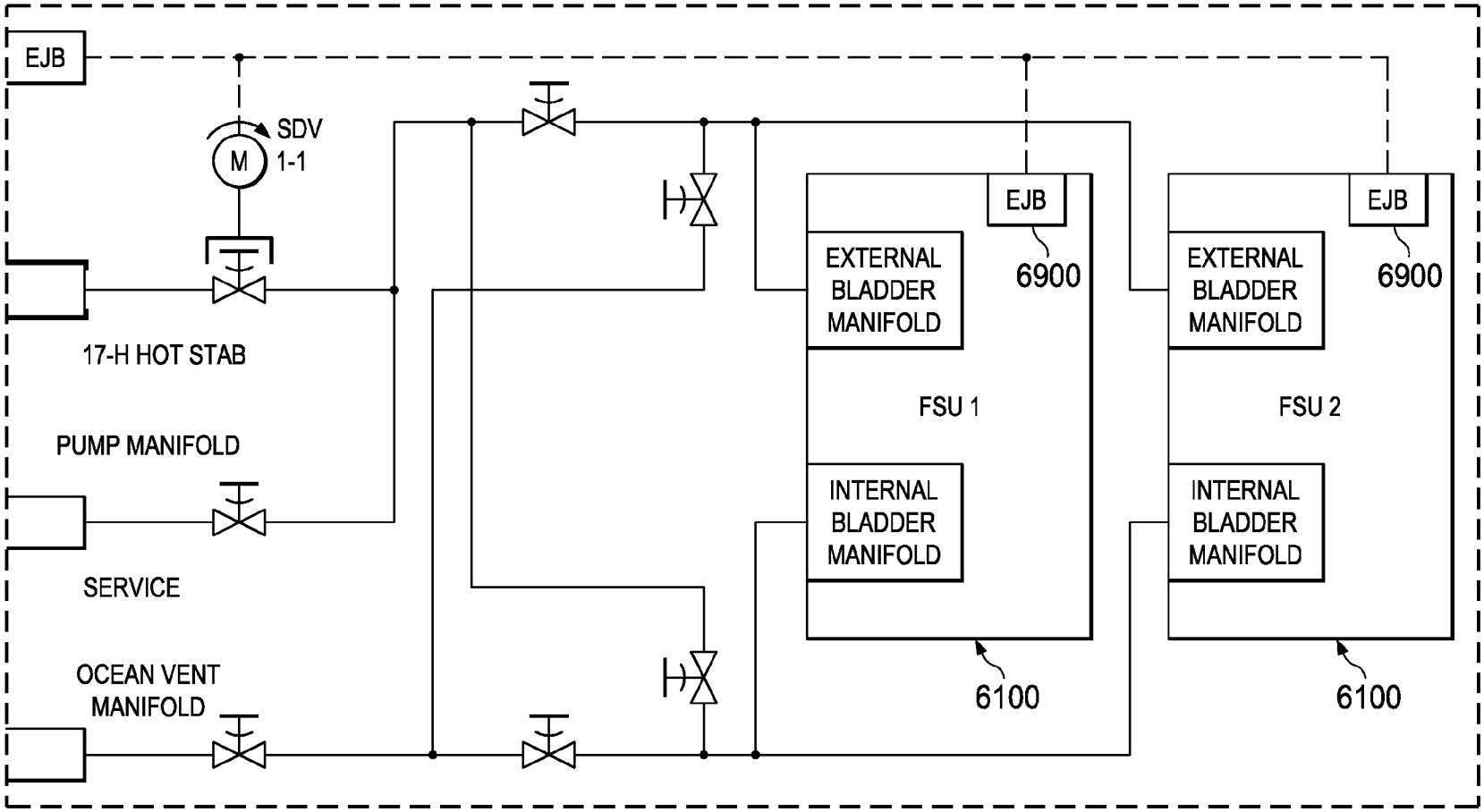

FIG. 6A illustrates a perspective view of a subsea fluid storage module according to a specific example embodiment of the disclosure;

FIG. 6B illustrates a perspective view of a subsea fluid storage module according to a specific example embodiment of the disclosure;

FIG. 6C illustrates an interface panel of a subsea fluid storage module according to a specific example embodiment of the disclosure;

FIG. 6D illustrates a schematic for a subsea fluid storage module according to a specific example embodiment of the disclosure;

DETAILED DESCRIPTION

The present disclosure relates, in some embodiments, to subsea fluid storage units, subsea fluid storage modules, and subsea fluid storage facilities with passive pressure compensation. Subsea fluid storage units, subsea fluid storage modules, and subsea fluid storage facilities may be completely submerged and/or located at or near (e.g., within a mile) a point of delivery, according to some embodiments.

As described herein, subsea fluid storage systems may comprise a plurality of subsea fluid storage modules and/or units. Each unit may have a standardized size and shape, for example, to promote greater ease in replacing or fitting units within a module. Each unit may include a vessel configured to contain one or more chemicals (e.g., chemicals in fluid form at ambient seawater temperatures). For example, each unit may comprise one vessel containing a single chemical. Individual subsea fluid storage units may be removed and/or replaced with little to no effect on the operation of the overall system. Damage to and/or leaks in systems organized in units and modules as disclosed may be easily identified and/or repaired.

Subsea fluid storage units may be secured or otherwise disposed within subsea fluid storage modules. Each unit in a module may contain any desired chemical, which may be the same or different from other unit(s) in the module. A module may comprise any number of units desired. For example, a module may comprise from about 1 to about 4 units. A module, in some embodiments, may comprise any other structural or functional components desired or required for a particular application. For example, a module may comprise a body onto or into which units are installed, one or more interfaces to connect (e.g., fluidically connect) each unit, and/or one or more regulators.

In some embodiments, a subsea storage module may comprise a body (e.g., a platform or skid) onto or into which units are installed (e.g., removably fixed). For example, a subsea storage skid formed from a plurality of I-beam segments. A plurality of I-beam segments may form a rectangular frame-like structure suitable for housing a plurality of subsea fluid storage units. Subsea fluid storage skids or subsea fluid storage modules may be transportable over-the-road and may promote greater ease in assembling a subsea fluid storage system. In some embodiments, subsea fluid storage skids or subsea fluid storage modules may be transported separately or individually prior to being deployed to a subsea environment or assembled as part of a subsea fluid storage system.

A module may comprise, in some embodiments, an interface panel. An interface panel may be fluidly connected to or be in fluid communication with a plurality of subsea fluid storage units housed within a subsea fluid storage skid. Accordingly, individual subsea fluid storage units may be filled or drained through an interface panel of a subsea fluid storage skid or a subsea fluid storage module. An interface panel may be operated by a Remotely Operated Vehicle (ROV) configured and/or designed for subsea deployment. An interface panel may also be operated at the surface by appropriate maintenance personnel.

In some embodiments, a module may comprise one or more mechanical and/or electronic regulators, sensors, and/or monitors. For example, a module may include flow regulators (e.g., valves) and/or sensors (e.g., flow meters). A module may include electronic controls that permit an operator(s) (e.g., on the sea surface) to assess and/or direct any desired metric of a unit or module's performance (e.g., flow, content, volume remaining, pressure, temperature, and/or combinations thereof). A unit may be filled, drained, washed, serviced, and/or otherwise operated without being removed from a subsea fluid storage skid or a subsea environment.

Subsea fluid storage modules may be secured on or otherwise disposed on a subsea platform to form a subsea fluid storage system. A subsea fluid storage system may comprise a plurality of subsea platforms having a plurality of subsea fluid storage skids disposed thereon. In some embodiments, a tank farm may refer to a plurality of subsea platforms on which a plurality of subsea fluid storage modules are disposed. A tank farm or a subsea fluid storage system may comprise a control system which may monitor the pressure and fluid level of every subsea fluid storage module. A control system may allow for fluid isolation of any subsea fluid storage module or subsea fluid storage unit.

Specific Example Embodiments

Specific example embodiments of subsea fluid storage systems are illustrated in FIGS. 1-7B.

Schematic Overview

FIG. 1 illustrates a schematic for subsea fluid storage unit 1000. As shown, subsea fluid storage unit 1000 may comprise vessel 1100. Bladder 1200 may be disposed within vessel 1100. Bladder 1200 may define internal bladder volume 1202. In some embodiments, bladder 1200 may be configured or designed to hold particular fluids or chemicals. Bladder 1200 may be formed from deformable or collapsible material. Thus, internal bladder volume 1202 may vary depending on the volume or amount of fluids stored or held therein.

Pressure Transducers

Vessel 1100 may comprise top port 1102 and bottom port 1106. Fluid lines may stem from each of top port 1102 and bottom port 1106. Each fluid line may have a differential pressure transducer, two pressure relief valves, and an isolation valve. For example, top pressure transducer 1904 may be connected to or otherwise coupled to a fluid line in fluid communication with top port 1102. Further, bottom pressure transducer 1906 may be connected to or otherwise coupled to a fluid line in fluid communication with bottom port 1106. Top pressure transducer 1904 and bottom pressure transducer 1906 may sense differential pressure between ambient and a fluid (e.g. seawater or stored chemical) in a fluid line to which the transducer is coupled. Various types of pressure transducers may be used to detect a differential pressure. Such variations in a type of pressure transducers may be made without departing from the scope of the present disclosure.

Pressure Relief Valves, Isolation Valves

A pressure relief valve may be coupled to a fluid line of the subsea fluid storage unit 1000. A pressure relief valve may relieve pressure, for example, by establishing a fluidic connection with a lower and/or higher pressure zone. A lower or higher pressure zone may be a fluid line, a separate chamber, and/or an external environment (e.g., open water). For example, release to a lower pressure zone may relieve over-pressure. In contrast, to resolve an under-pressure condition, a relief valve may act to allow additional ambient fluid to enter the subsea fluid storage unit 1000.

An isolation valve may be a manual ball valve which may be open during operation. In other circumstances, an isolation valve may typically be closed. For example, an isolation valve may be closed during transportation or when a subsea fluid storage unit is otherwise not installed or secured to a subsea fluid storage module.

Level Transducers

As shown in FIG. 1, subsea fluid storage unit 1000 may comprise level transducer 1902. Level transducer 1902 may be a level sensor disposed within a subsea fluid storage unit. Level transducer 1902 may be coupled to bladder 1200 and may be operable to detect or sense a level of fluid in a subsea fluid storage unit.

Electrical Junction Box

Subsea fluid storage unit 1000 may further comprise electrical junction box 1900. Electrical junction box 1900 may be disposed on and/or secured to the outside of vessel 1100. Electrical junction box 1900 may be configured to receive a variety of electrical inputs or other signals. For example, in some embodiments, subsea fluid storage unit 1000 may comprise vessel 1100 outputting signals from top pressure transducer 1904, bottom pressure transducer 1906, and level transducer 1902. Electrical junction box 1900 may receive the aforementioned signals and provide them to a processing unit of a subsea fluid storage module. In such manner, a subsea fluid storage module may be able to coordinate and control the operations of each subsea fluid storage unit 1000 to which it is coupled.

Subsea Fluid Storage Unit; Overview

Figure 2A:
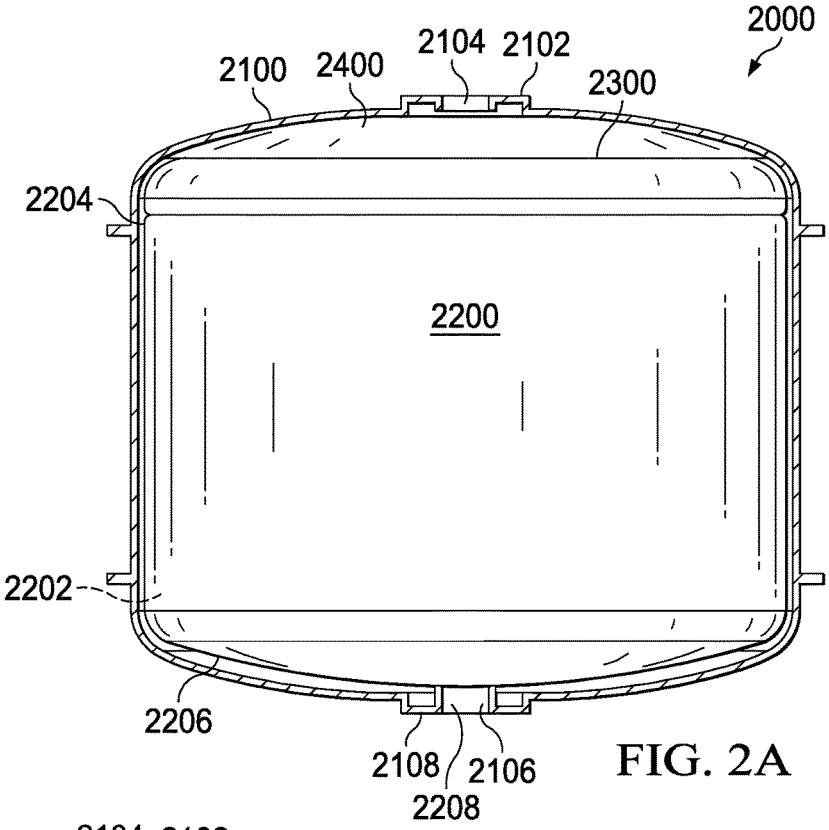
FIG. 2A illustrates a section view of a subsea fluid storage unit according to a specific example embodiment of the disclosure.
Figure 2B:
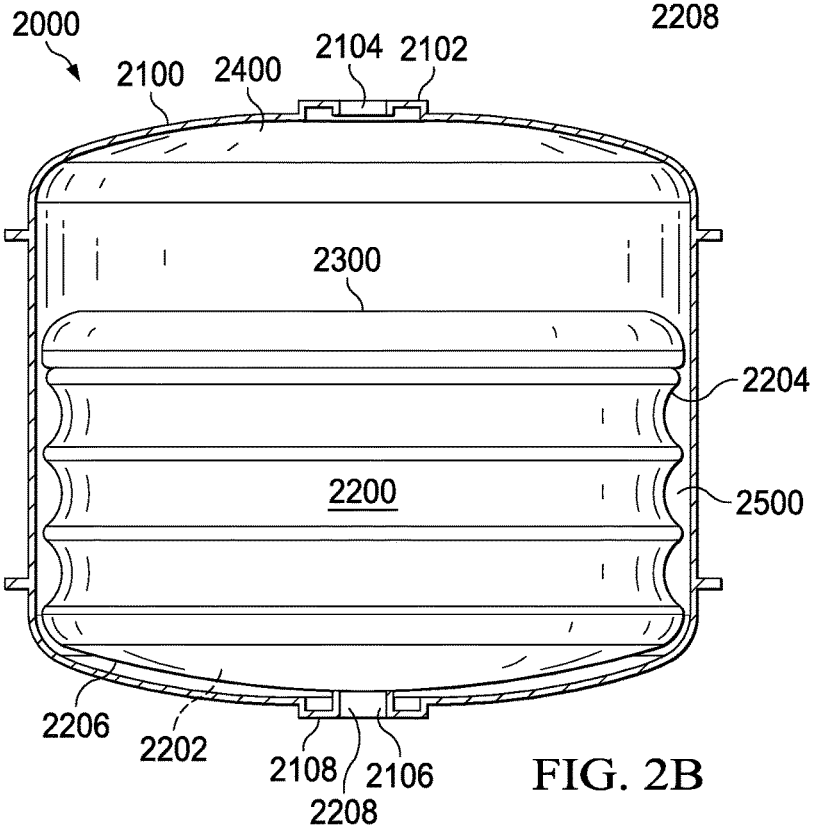
FIG. 2B illustrates a section view of a subsea fluid storage unit according to a specific example embodiment of the disclosure.
Figure 2C:
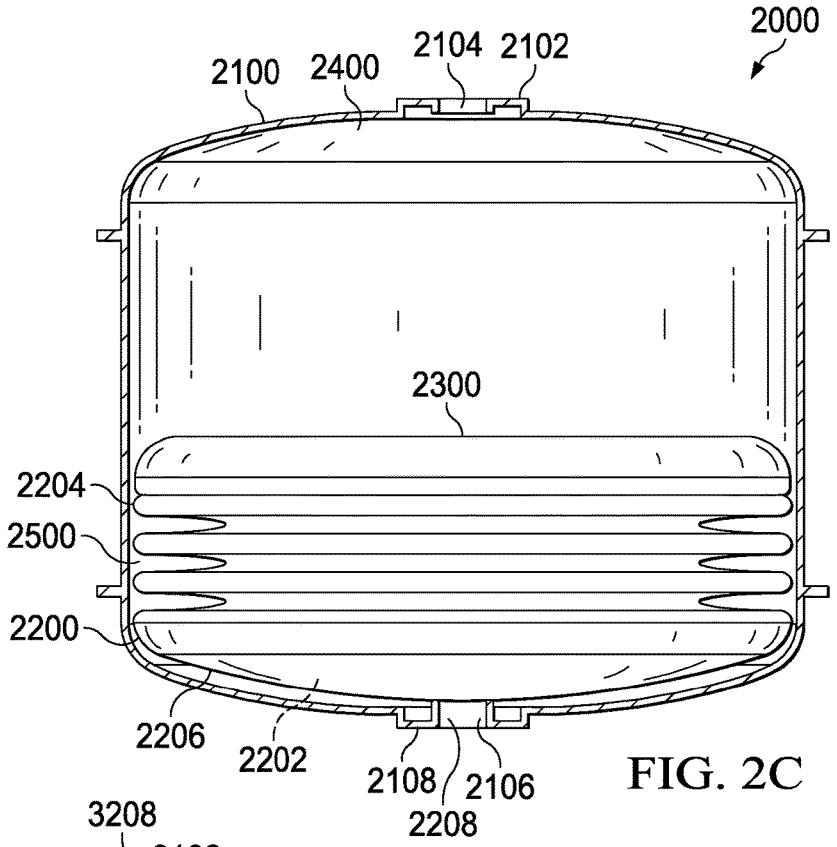
FIG. 2C illustrates a section view of a subsea fluid storage unit according to a specific example embodiment of the disclosure.

FIGS. 2A-C illustrate section views of subsea fluid storage unit 2000 according to specific example embodiments of the disclosure. As shown in FIG. 2A, subsea fluid storage unit 2000 may comprise vessel 2100 housing bladder 2200. Vessel 2100 may comprise top port 2012, defining top opening 2104, and bottom port 2106, defining bottom opening 2108. Bladder 2200 may allow for separation of a desired fluid for storage and an ambient environment fluid, such as seawater.

Bladder

In some embodiments, bladder 2200 may be formed from deformable material such that internal bladder volume 2202 of bladder 2200 varies depending on the volume of content stored therein. Bladder 2200 may comprise various materials such as any suitable elastomers or rubbers. Particular materials used for bladder 2200 may vary depending on chemical properties of a fluid chosen for storage. Bladder 2200 may expand or contract depending on the amount of fluid or chemicals stored therein. Accordingly, internal bladder volume 2202 may increase or decrease in a similar manner as well along with a corresponding decrease in the external bladder volume.

Piston

Bladder 2200 may comprise first end 2204 and second end 2206. Piston 2300 may be disposed adjacent to first end 2204 of bladder 2200. In some embodiments, piston 2300 may be secured to first end 2204 of bladder 2200 such that any expansion, contraction, or other movement of bladder 2200 would result in a positional change of piston 2300. Piston 2300 may help promote or ensure predictable or consistent deformation of bladder 2200 when fluids are drained from or filled into bladder 2200. Additionally, piston 2300 may provide a surface or physical feature on to which additional features or sensors may be secured. For example, a level transducer may be secured on piston 2300 such that the position of piston 2300 may be detected. Various pistons 2300 may be used without departing from the scope of the present disclosure. In some embodiments, piston 2300 may be weighted, neutral, or buoyant, depending on a density of a stored fluid. In some embodiments, piston 2300 may be configured to engage (e.g., slidably engage) a wall (e.g., an interior wall) of vessel 2100 at one or more points. For example, an interior wall of vessel 2100 may be configured to have two or more guide tracks along the height of vessel 2100, each matable with a corresponding boss or a corresponding groove on piston 2300.

Piston 2300 may be weighted based on densities of both a stored fluid and an ambient fluid. In some embodiments, vessel 2100 may be arranged or position such that a denser fluid may be on the bottom. If a stored fluid is on bottom, piston 2300 may be weighted. If a stored fluid is on top, piston 2300 may be buoyant. A net weight and/or buoyancy of piston 2300 may be chosen to produce a desired net pressure on a stored fluid. In some embodiments, a net weight and/or buoyancy may be about 1-2 psi above an ambient pressure.

Bladder 2200 may have mechanical features to allow it to be attached to or be secured to corresponding features on the piston 2300. Examples of mechanical features may include, but are not limited to belt loops, hooks, and/or carabiners.

Bladder Opening; Top Port and Bottom Port

Second end 2206 of bladder 2200 may comprise bladder opening 2208. Bladder opening 2208 may be secured to top port 2012 or bottom port 2106 of vessel 2100. In such manner, bladder opening 2208 may be fluidically connected with or be in fluid communication with top opening 2102 or bottom opening 2108 of vessel 2100. Such arrangement may allow a desired fluid, such as a chemical for storage or seawater, to be introduced into bladder 2200 through either top opening 2102 or bottom opening 2108 of vessel 2100. Further, while one opening 2102, 2108 may be in fluid communication with bladder 2200, the other opening 2102, 2108 may be in fluid communication with an ambient environment. In some applications, an ambient environment may comprise seawater. Thus, while one opening 2102, 2108 may allow a desired chemical for storage to enter or exit, another opening 2012, 2108 may allow seawater to enter or exit.

Internal Bladder Volume

As shown in FIG. 2A, bladder 2200 may comprise internal bladder volume 2202 that, in a fully expanded state, may have a substantially similar to a volume of vessel 2100 when bladder 2200 is completely full. In such manner, substantially all or most of a volume of vessel 2100 may be used to store a desired fluid within internal bladder 2202 of bladder 2200. Thus, bladder 2200 may be expanded within vessel 2100 such that there may be little or no external bladder volume 2400 left within vessel 2100.

As shown in FIG. 2A, bladder opening 2208 may be secured to bottom port 2106 of vessel 2100. Thus, a fluid or chemical stored within bladder 2200 may be drained from bottom port 2106 through bottom opening 2108. More specifically, a fluid or chemical stored within bladder 2200 may pass through bladder opening 2208 and bottom opening 2108. A fluid or chemical drained in such manner may then be transported or passed along via a fluid line to an intended location for particular uses.

As shown in FIG. 2B, bladder 2200 may be formed from deformable or flexible material. In some embodiments, bladder 2200 may comprise materials deformable or flexible enough such that differential pressures in an ambient fluid environment would not damage bladder 2200. As a fluid or chemical stored within bladder 2200 is drained, a deformable material of bladder 2200 may allow bladder 2200 to collapse or contract. Such collapsing or contracting may decrease internal bladder volume 2202 of bladder 2200. A decrease of internal bladder volume 2202 may allow additional fluids, such as seawater, to enter vessel 2100. Furthermore, as internal bladder volume 2202 decreases, a vacuum effect may occur and drawn in ambient fluid, such as seawater, from top opening 2104. Seawater may enter vessel 2100 through top opening 2104 as defined by top port 2102. As seawater enters, greater pressure may be exerted on piston 2300 and piston 2300 may be lowered. As internal bladder volume 2202 decreases, folds or wrinkles in a material of bladder 2200 may occur. Side recess volume 2500 may form along lateral portions of vessel 2100.

FIG. 2C illustrates an embodiment as a fluid or chemical stored within bladder 2200 is further drained. As shown in FIG. 2C, a fluid or chemical stored within bladder 2200 may be nearly completely drained such that bladder 2200 may be nearly or entirely collapsed. In this state, bladder 2200 may have a very small internal bladder volume 2202. Much of the bladder 2200 material may be collected or collapsed near bottom port 2106 of vessel 2100 to which bladder opening 2208 may be secured. As shown in FIG. 2C, external bladder volume 2400 may increase substantially as bladder 2200 is drained. An increase in external bladder volume 2400 provides additional space for the receipt of seawater or other ambient fluids. Accordingly, as internal bladder volume 2202 changes, an introduction of seawater into vessel 2100 may provide for dynamic pressure compensation.

In some embodiments, a plurality of elastic bands may be provided around a waist of bladder 2200. Elastic bands may act to control deformation of bladder 2200. Further, elastic bands may apply a slight pressure to a fluid in bladder 2200 toward higher fill states to promote synchronized filling of a plurality of subsea fluid storage units.

Internal Pressure

According to some embodiments, a volume within vessel 2100 that is external to bladder 2200 (e.g., an internal vessel volume) may be exposed to and/or in fluid communication with an ambient environment or fluid, such as seawater. Further, bladder 2200 may not resist or may provide little resistance to changes in volume. Thus, pressure within bladder 2200 may be very close to ambient pressure while subsea fluid storage unit 2000 is operating at subsea depths. Described further, a pressure differential across walls of vessel 2100 and across bladder 2200 may be very low while subsea fluid storage unit 2000 is operating at subsea depths. Exposure of external bladder volume 2400 to seawater may allow for dynamic pressure compensation of subsea fluid storage unit 2000. Dynamic pressure compensation of subsea fluid storage unit 2000 may allow for more reliable storage units that may require less maintenance, repair, and/or other servicing. As such, subsea fluid storage units 2000 of the present disclosure may be suitable for prolonged exposure in subsea environments and may provide for long term storage of fluids in subsea environments.

Alternative Configuration of Bladder

FIGS. 3A-C illustrate section views of subsea fluid storage unit 3000 according to some example embodiments of the present disclosure. As shown in FIG. 3A, in some embodiments, first end 3204 of bladder 3200 may be closer to bottom port 3106 of vessel 3100. As previously described, piston 3300 may be adjacent to or secured to first end 3204 of bladder 3200. Thus, piston 3300 in subsea fluid storage unit 3000 may also be closer to bottom port 3106 of vessel 3100.

As previously explained, bladder opening 3208 may be secured to top port 3012 or bottom port 3106 of vessel 3100. As shown in FIG. 3A, in some embodiments, second end 3206 of bladder 3200 may be secured to top port 3012. In the arrangement of FIG. 3A, a fluid connectivity of top port 3012 and bladder opening 3208 may allow bladder 3200 to be filled or drained via top opening 3104 as defined by top port 3012. When bladder 3200 is completely filled, internal bladder volume 3202 may occupy substantially all of the internal volume of vessel 3100.

As a fluid is drained, bladder 3200 may begin to collapse. As shown in FIG. 3B, a partially drained bladder 3200 may comprise a reduced or lesser internal bladder volume 3202. A decrease of internal bladder volume 3202 may allow additional fluids, such as seawater, to enter vessel 3100. Seawater may enter vessel 3100 through bottom opening 3108 as defined by bottom port 3106. As seawater enters, greater pressure may be exerted on piston 3300 and piston 3300 may move to an elevated position. Alternatively, piston 3300 may move as it may be secured to second end 3204 of vessel 3200. As internal bladder volume 3202 decreases, folds or wrinkles in a material of bladder 3200 may occur. Side recess volume 3500 may form along lateral portions of vessel 3100.

FIG. 3C illustrates subsea fluid storage unit 3000 when a fluid or chemical stored within bladder 3200 is further drained. As shown in FIG. 3C, a fluid or chemical stored within bladder 3200 may be nearly completely drained such that bladder 3200 is nearly or entirely collapsed. In this state, bladder 3200 may have a very small internal bladder volume 3202. Much of the bladder 3200 material may be collected or collapsed near top port 3102 of vessel 3100 to which bladder opening 3208 is secured. As shown in FIG. 3C, external bladder volume 3400 may increase substantially as bladder 3200 is drained. An increase in external bladder volume 3400 provides additional space for the receipt of seawater or other ambient fluids. Seawater or other ambient fluids may be introduced into vessel 3100 through bottom opening 3108, as defined by bottom port 3106. Accordingly, as internal bladder volume 3202 changes, an introduction of seawater into vessel 3100 may provide for dynamic pressure compensation.

In some embodiments, disposing a fluid with a higher specific gravity at a lower position within vessel 3100 may be desired or required. Such arrangement may promote the draining of a fluid with bladder 3200 out of vessel 3100. Thus, in embodiments where a fluid desired for storage has a higher specific gravity than seawater, it may be desired or required to configure a subsea fluid storage unit as those shown in FIGS. 2A, 2B, and 2C. In embodiments where a fluid desired for storage has a lower specific gravity than seawater, it may be desired or required to configure a subsea fluid storage unit as those shown in FIGS. 3A, 3B, and 3C.

Level Transducer

FIG. 4 illustrates a section view of subsea fluid storage unit 4000 according to specific example embodiments of the present disclosure. FIG. 4 illustrates various level transducers or level detecting sensors that may be used in conjunction with any embodiments of the present disclosure, such as the previously described embodiments.

As previously described, position of piston 4300 within vessel 4100 may vary as internal bladder volume 4202 of the bladder 4200 varies. Thus, determining a position of piston 4300 may indicate or reveal information regarding internal bladder volume 4202 of bladder 4200. For example, as shown in FIG. 4, a low position of piston 4300 may indicate that bladder 4200 may be substantially drained or empty. In some circumstances, this may indicate that bladder 4200 requires refilling. In contrast, a high position of piston 4300 may indicate that bladder 4200 may be substantially full. The present disclosure provides for various ways of determining a position of piston 4300.

As shown in FIG. 4, subsea fluid storage unit 4000 may comprise internal Linear Variable Differential Transformer (LVDT) 4112. Internal LVDT 4112 may be used in conjunction with external LVDT 4114 to determine a position of piston 4300. For example, external LVDT may detect the position of a magnet or signal mounted within infernal LVDT 4112. Various types of internal and external LVDT may be used without departing from the scope of the present disclosure.

Additionally or alternatively, subsea fluid storage unit 4000 may comprise altimeter 4110 operable or configured to detect a location of piston 4300 within vessel 4100. Altimeter 4110 may detect a distance away from piston 4300, and such data may allow a practitioner to determine internal bladder volume 4202 of bladder 4200.

Additionally or alternatively, subsea fluid storage unit 4000 may allow for determination of a position of piston 4300 via visual inspection. Subsea fluid storage unit 4000 may comprise a porthole or other transparent or see-through section along a portion of vessel 4100. In such manner, visual inspection may be sufficient to determine a position of piston 4300. Visual inspection may be performed topside by appropriate practitioners or may be performed remotely by a ROV deployed in a subsea environment.

Alternative Configurations

Embodiments of the present disclosure provide for bladder 1200, 2200, 3200, 4200 disposed within vessel 1000, 2000, 3000, 4000. In some embodiments, a fluid desired for storage may be stored within bladder 1200, 2200, 3200, 4200. External bladder volume 2400, 3400, 4400 in vessel 1000, 2000, 3000, 4000 may be provided to accommodate seawater or other ambient fluid as a pressure compensator. However, in other embodiments of the present disclosure, the reverse may be true. Described further, in some embodiments, a fluid desired for storage may be stored within external bladder volume 2400, 3400, 4400 of vessel 1000, 2000, 3000, 4000. Bladder 1200, 2200, 3200, 4200 may be utilized to accommodate seawater or other ambient fluid as a pressure compensator. In operation, embodiments of the latter arrangement may allow seawater or other ambient fluid to flow into bladder 1200, 2200, 3200, 4200. An addition of seawater or other ambient fluid into bladder 1200, 2200, 3200, 4200 may serve as a dynamic pressure compensator for a chemical stored in external bladder volume 2400, 3400, 4400 of vessel 1000, 2000, 3000, 4000.

Vessel; Features

Figure 5A:
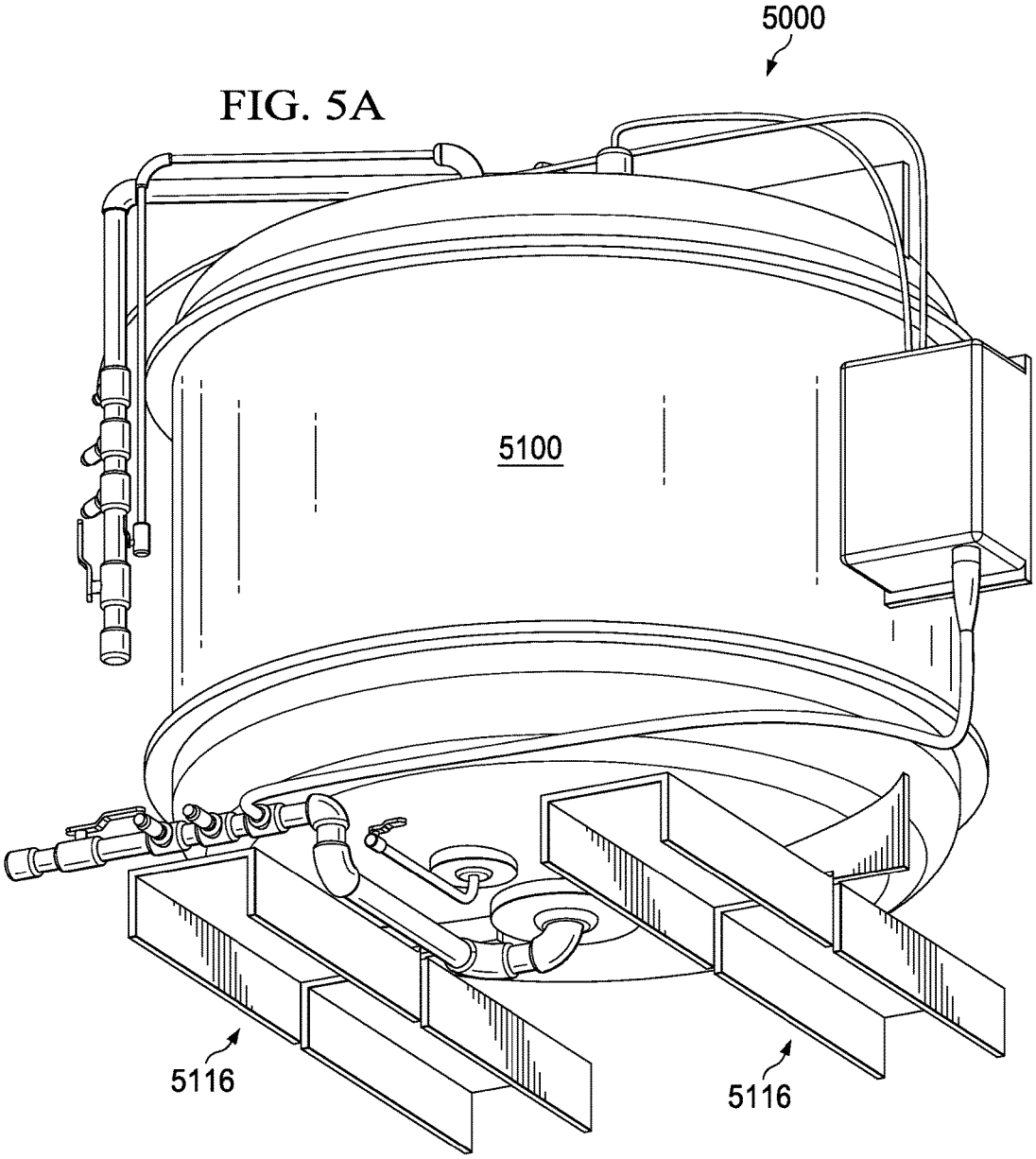
FIG. 5A illustrates a perspective view of a subsea fluid storage unit according to a specific example embodiment of the disclosure.
Figure 5B:
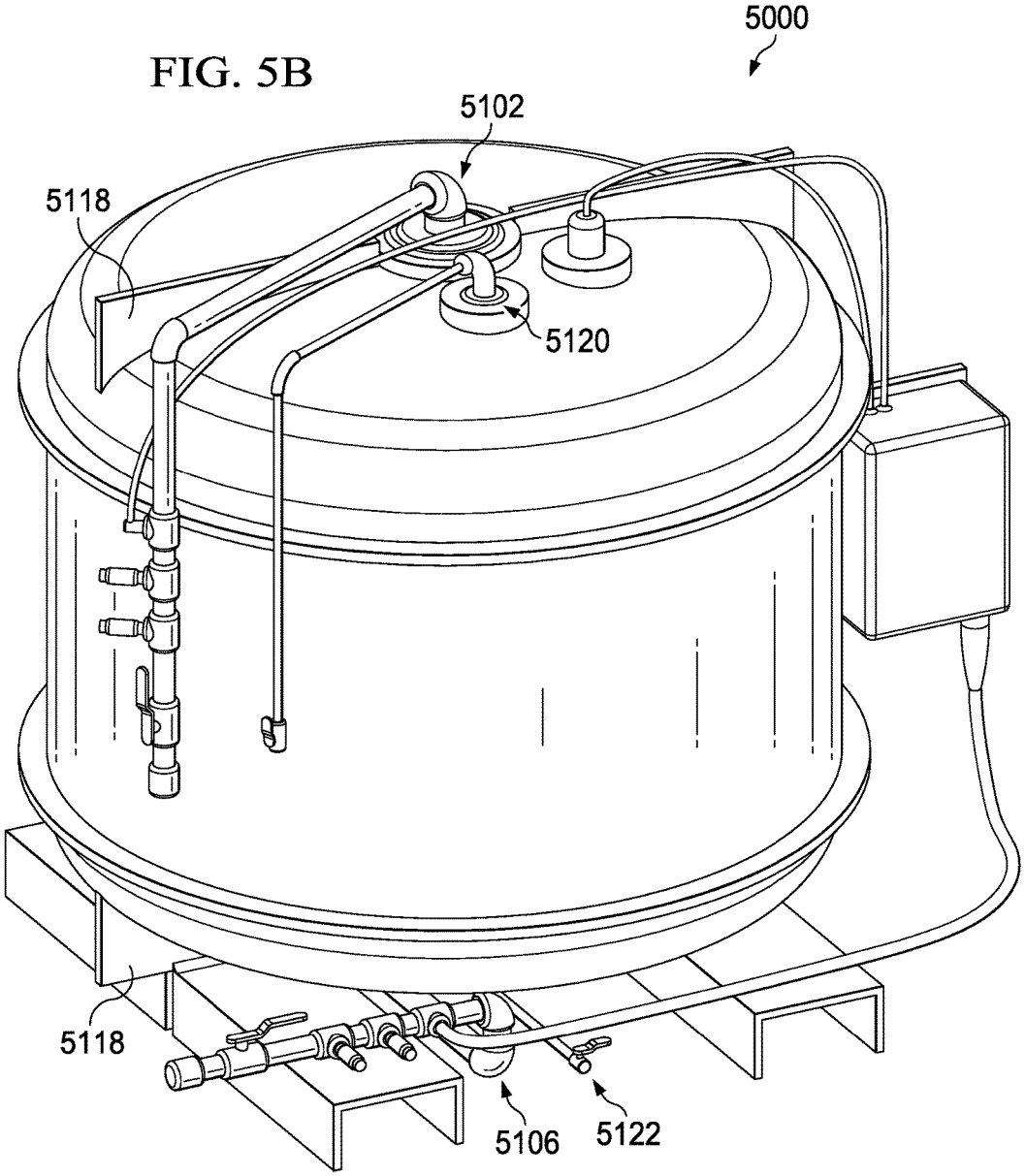
FIG. 5B illustrates a perspective view of a subsea fluid storage unit according to a specific example embodiment of the disclosure.
Figure 5C:
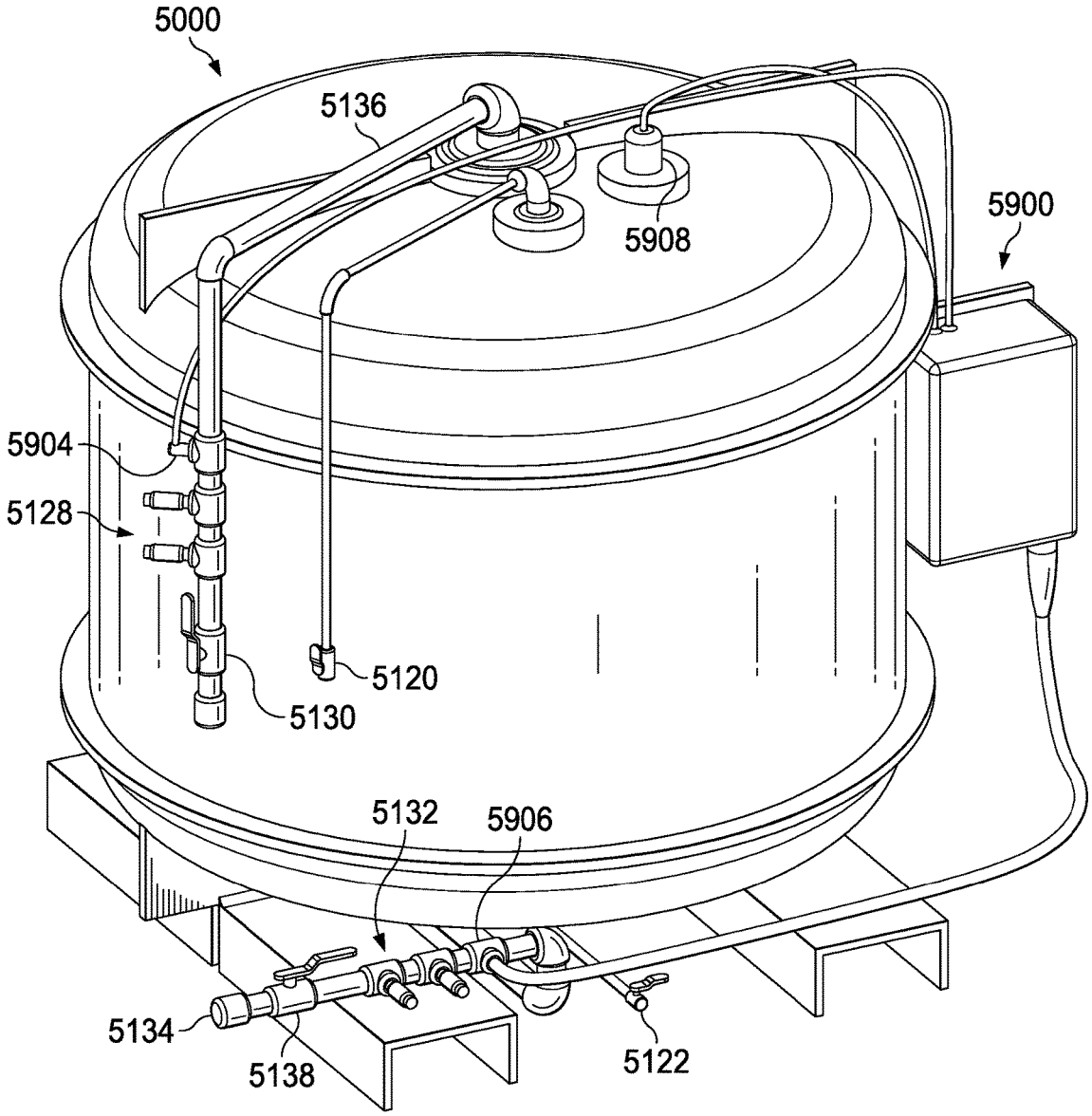
FIG. 5C illustrates a perspective view of a subsea fluid storage unit according to a specific example embodiment of the disclosure.

Subsea fluid storage units of the present disclosure may comprise various features. FIGS. 5A-5C illustrate perspective views of subsea fluid storage unit 5000 according to specific example embodiments of the disclosure. As shown in FIG. 5A, vessel 5100 may comprise handling features 5116. Handling features 5116 may be disposed at a base of vessel 5100. Handling features 5116 may comprise a plurality of segments that may be designed to mate with an instrument such as a forklift or other elevating device. In such manner, handling features 5116 may promote greater ease in transporting and/or assembling subsea fluid storage unit 5000 as part of a subsea fluid storage system.

As shown in FIG. 5B, vessel 5100 may comprise a top fluid line extending from top port 5102. Top vent port 5120 may be disposed at a top side of vessel 5100, adjacent to top port 5102. On a bottom side of vessel 5100, there may be disposed a bottom port 5106 and a drain port 5122.

Top vent port 5120 and drain port 5122 may be configured for use during topside maintenance. Top vent port 5120 may be opened during topside filling operations so that air outside a bladder may escape from vessel 5100. Drain port 5122 may be used to drain seawater or other fluids from vessel 5100.

As shown in FIG. 5C, vessel 5100 may further comprise external bladder header 5136, internal bladder header 5134, top isolation valve 5130, bottom isolation valve 5138, top pressure relief valve 5128, and bottom pressure relief valve 5132. Top isolation valve 5130 and bottom isolation valve 5138 may provide isolation of fluid contents during transportation and maintenance. Top pressure relief valve 5128 and bottom pressure relief valve 5132 may be utilized during system overpressure and system underpressure.

Vessel 5100 may comprise a substantially cylindrical shell and two dished and flanged tank heads. Vessel 5100 may serve to isolate the stored chemicals from an ambient environment. For example, in the event that there is a leak in a bladder, a stored chemical may leak from a bladder into vessel 5100. However, the construction of vessel 5100 may serve to isolate any chemicals from an ambient environment. Such feature may be desired or required during both transportation and subsea operations.

Vessel 5100 may also carry loads that may exist when a system is filled with fluid and is not submerged. When vessel 5100 is not deployed in a subsea environment, pressure within vessel 5100 may not be counteracted by pressure compensation from in-flowing seawater. Accordingly, vessels 5100 of the present disclosure may be constructed so as to withstand a load from the aforementioned pressure.

Vessel; Electronic Junction Boxes

Further, subsea fluid storage unit 5000 may comprise electronics junction box 5900. Electronics junction box 5900 may receive signals from various sources. For example, signals or data may be received from top pressure transducer 5904 and bottom pressure transducer 5906. Signals or data may also be received from level sensor 5908. Level sensor 5908 may be coupled to any of the previously mentioned features for detecting or determining a position of a piston within a vessel. For example, in some embodiments, level sensor 5908 may be an altimeter or may be coupled to an altimeter such that level sensor 5908 may relay signals or data to electronics junction box 5900 regarding a position of a piston within vessel 5100. Receiving signals regarding pressure or piston position at electronics junction box 5900 may allow embodiments of the present disclosure to remotely detect or determine the state of a subsea fluid storage unit 5000, such as fluid line pressures and stored fluid level.

Vessel; Dimensions and Materials

Vessels 5100 of the present disclosure may provide for great variety in fluid storage capacity. For example, vessels 5100 may allow for fluid storage capacities of 100 bbl, 5000 bbl, and 1000 bbl. Any other capacities may be achieved as desired by a practitioner or as necessary for particular applications. Vessels 5100 may also be constructed or produced from materials suitable for subsea deployment. For example, depending on an amount of fluids or chemicals desired to be stored, dimensions for vessel 5100 may vary. Various benefits may be achieved from adjusting the size of vessel 5100. For example, a larger vessel 5100 may allow for storage of larger volumes of a particular fluid. As another example, a smaller vessel 5100 may allow for greater ease in the transportation and/or assembly of smaller vessel 5100. Where greater volumes of a particular fluid are needed, multiple smaller vessels 5100 may be used to store the same chemicals. Further, vessels 5100 may comprise interiors with anti-corrosive protection such that various chemicals or fluids desired for storing may be stored therein without damage to vessels 5100.

Subsea Fluid Storage Module

As previously described, subsea fluid storage units may be secured or otherwise disposed within subsea fluid storage modules. FIG. 6A illustrates a perspective view of a subsea fluid storage module according to a specific example embodiment of the present disclosure. As shown in FIG. 6A and FIG. 6B, subsea fluid storage units 6000 may be disposed within or housed in subsea fluid storage skid 6600.

In some embodiments, subsea fluid storage skid 6600 may comprise a plurality of steel I-beam frame members forming a rectangular design. Subsea fluid storage skid 6600 may comprise a plurality of removable frame members 6602 such that subsea fluid storage skid 6600 may be easily opened or disassembled in such a manner so that subsea fluid storage units 6000 may be easily or conveniently placed into subsea fluid storage skid 6600.

Various features may promote the transportation, deployment, or other manipulation of subsea fluid storage skid 6600. ISO corners 6604 may be provided at the corners of subsea fluid storage skid 6600. Further, DNV lift points 6608 may be provided at particular locations across a steel frame design of subsea fluid storage skid 6600. Still further, forklift handling features 6606 may be provided at a base of a subsea fluid storage skid 6600. Such features may allow forklifts or other transportation equipment to safety and securely move subsea fluid storage skid 6600, regardless of whether it is housing subsea fluid storage units 6000.

FIG. 6A and FIG. 6B illustrate subsea fluid storage skid 6600 housing two subsea fluid storage units 6000. However, depending on the size of subsea fluid storage skid 6600 or subsea fluid storage units 6000, any number of subsea fluid storage units 6000 may be disposed within subsea fluid storage skid 6600. Accordingly, subsea fluid storage modules of the present disclosure may comprise any number of subsea fluid storage units 6000. For example, a subsea fluids storage module comprising a larger subsea fluid storage skid 6600 may comprise three or four subsea fluid storage units 6000 housed within subsea fluid storage skid 6600.

As shown in FIG. 6B, subsea fluid storage skid 6600 of a subsea fluid storage module may comprise wiring harnesses 6610, fluid manifolds 6612, and automated valve 6614. Fluid lines from each subsea fluid storage units 6000 may be connected to fluid manifold 6612 of a subsea fluid storage module. Fluid manifold 6612 may contain various valves which may allow the lines to routed appropriately. One fluid line from each subsea fluid storage unit 6000 may be routed to automated valve 6614. Other fluid lines from each subsea fluid storage unit 6000 may be routed to seawater intake valves on interface panel 6700.

Subsea Fluid Storage Module; Interface Panel

Interface panel 6700 of a subsea fluid storage module may coordinate draining and/or filling of subsea fluid storage units 6000. FIG. 6C illustrates a close-up view of interface panel 6700 of a subsea fluid storage module according to a specific example embodiment of the present disclosure. In some embodiments, interface panel 6700 may be a Remotely Operated Vehicle (ROV) interface panel. Accordingly, an ROV may be deployed in a subsea environment to an interface panel and the interface panel may be remotely operated using the ROV.

As shown in FIG. 6C, interface panel 6700 may comprise pressure gauges 6702, sea water intake 6704, wet mate connectors 6706, hot stab interface 6708, service fluid port 6710, and ROV controlled valves 6712. Hot stab interface 6712 may be utilized for a main fluid line, which may be routed to automated valve 6614. Automated valve 6614 may be controlled by an overall control system of a subsea fluid storage system. Automated valve 6614 may allow a subsea fluid storage module to be isolated from other subsea fluid storage modules during filling and draining operations. Such feature may be useful in cases where a fluid level or pressure level in subsea fluid storage unit 6000 may be higher or lower than desired.

Service fluid port 6710 may also be connected to a main fluid line and may be used during topside filling operations. A ball valve may be used to close off service fluid port 6710 when it may not in use.

Sea water intake 6704 may comprise a plurality of fluid lines routed to a corresponding port on each subsea fluid storage units 6000. In such arrangement, sea water intake 6704 may allow for free flow of sea water into and out of each subsea fluid storage units 6000.

Subsea fluid storage units 6000 may comprise a plurality of fluid lines. For example, in some embodiments, subsea fluid storage unit 6000 may comprise two fluids lines, one stored fluid line and one seawater line. These lines may be coupled to interface panel 6700 such that each fluid line may be manually opened or closed via ROV controlled valves 6712. ROV controlled valves 6712 may allow for particular fluid lines to be shut off or opened during emergency situations.

Wet mate connectors 6706 may be provided for electrical signal lines. An input signal may control automated valve 6614 to control fluid flow into and out of a subsea fluid storage module. Output signals may come from each subsea fluid storage unit 6000 for pressure and fluid level.

Interface panel 6700 of a subsea fluid storage module may also comprise an emergency quick disconnect feature to cut off circulation and fluid communication between a subsea fluid storage module, any subsea fluid storage units 6000 contained therein, and a device that may be operably linked to interface panel 6700. For example, a subsea ROV or subsea pump deployed in a subsea environment may engage interface panel 6700 to perform various tasks by operation of controls thereon and/or by establishing fluid communication with subsea fluid storage units 6000. An emergency quick disconnect, whether operated using an ROV or remote controls on the surface or elsewhere, may cut off a fluid communication and quickly terminate ongoing operations, for example, in case of a leak or other undesired or dangerous condition.

A schematic of a subsea fluid storage module, including some of the aforementioned features, is shown in FIG. 6D. Utilizing the aforementioned features, embodiments of the present disclosure allow for subsea servicing and refilling of subsea fluids storage units 6000 installed within subsea fluid storage skids 6600. In some embodiments, it may be desired to bring subsea fluid storage units topside for refilling, servicing and/or repair. In some embodiments, subsea fluid storage units may be refilled using an umbilical. An umbilical used in conjunction with the presently disclosed subsea fluid storage units may be deployed on site (e.g., from a platform or service ship much closer to the subsea fluid storage units). Such locally deployed umbilicals may thus operate at significantly lower pressures. Thus, difficulties associated with higher pressures may be reduced or avoided. In some embodiments, subsea fluid storage units may be refiled in a subsea environment by, for example, the use of an ROV. An ROV may interface with interface panel 6700 of subsea fluid storage skid 6600. Manipulation of various valves on interface panel 6700 may allow an ROV to completely or partially refill or drain bladders within subsea fluid storage skids 600. In some embodiments, chemical refill may be accomplished by directly swapping out subsea fluid storage unit 6000 with another subsea fluid storage unit 6000 with a desired amount or fluid or chemical stored therein. A desired amount of fluid or chemical stored within a deployed subsea fluid storage unit 6000 may or may not be the same as a maximum capacity or volume or a subsea fluid storage unit 6000. The option and capability of subsea servicing and subsea refilling may prolong the operating life of a subsea fluid storage unit 6000, decrease the cost involved with subsea fluid storage operations, and reduce the risk associated with any leakage or damage incurred while retrieving a deployed subsea fluid storage unit 6000.

Further, embodiments of the present disclosure may allow for a subsea fluid storage unit 6000 to be drained in its subsea environment, and refilled with a new chemical, regardless of whether the new chemical is the same or different as a chemical previously stored in subsea fluid storage unit 6000. However, refilling of subsea fluid storage unit 6000 with a different chemical may require considerations of the chemical makeup of a bladder in subsea fluid storage unit 6000. In some embodiments, it may be desired or required to bring subsea fluid storage unit 6000 topside for servicing and repurposing. Once appropriate maintenance and/or cleaning has been performed, the same subsea fluid storage unit 6000 may be used to store a different chemical.

Subsea Fluid Storage System

Figure 7A:
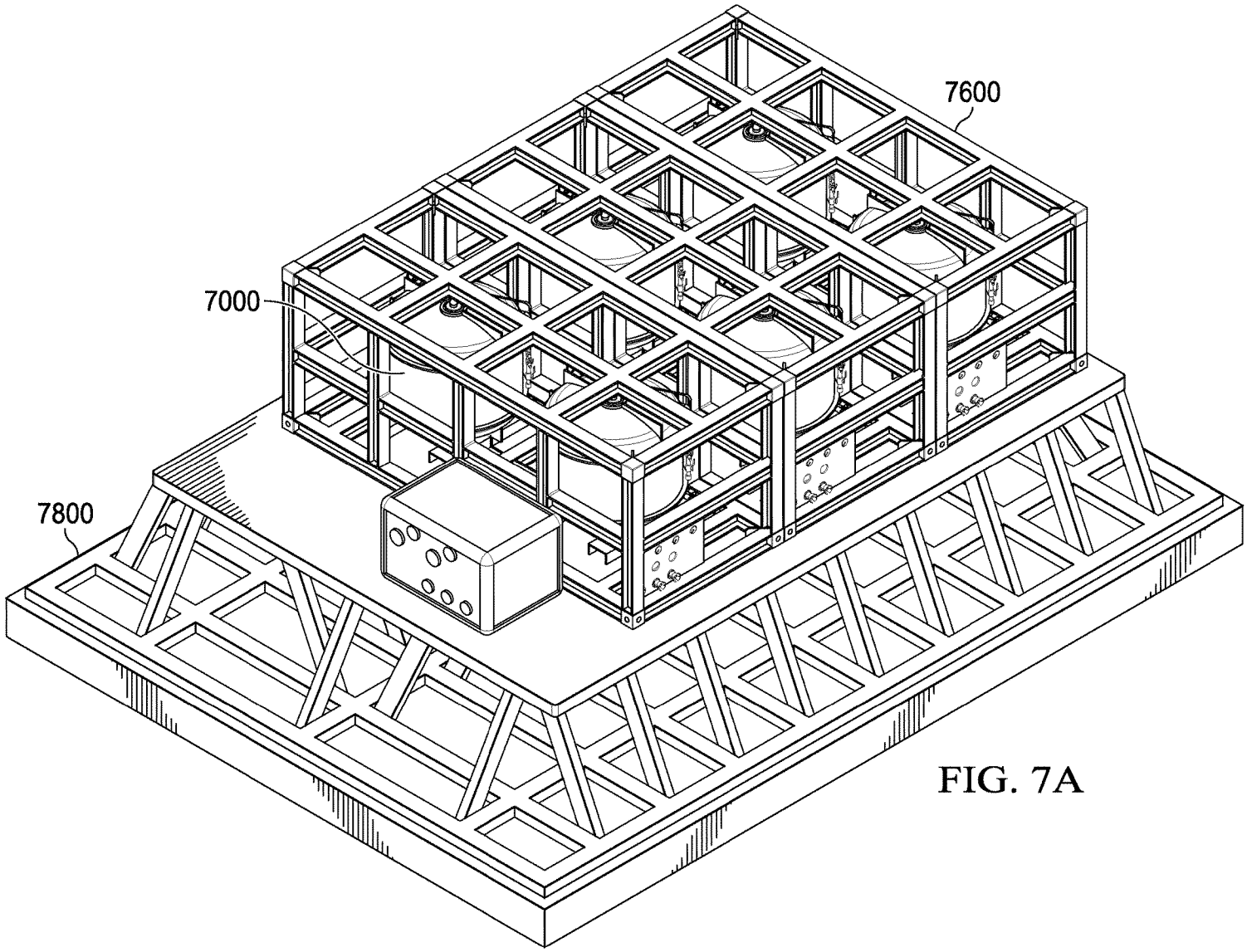
FIG. 7A illustrates a perspective view of a subsea fluid storage facility according to a specific example embodiment of the disclosure.
Figure 7B:
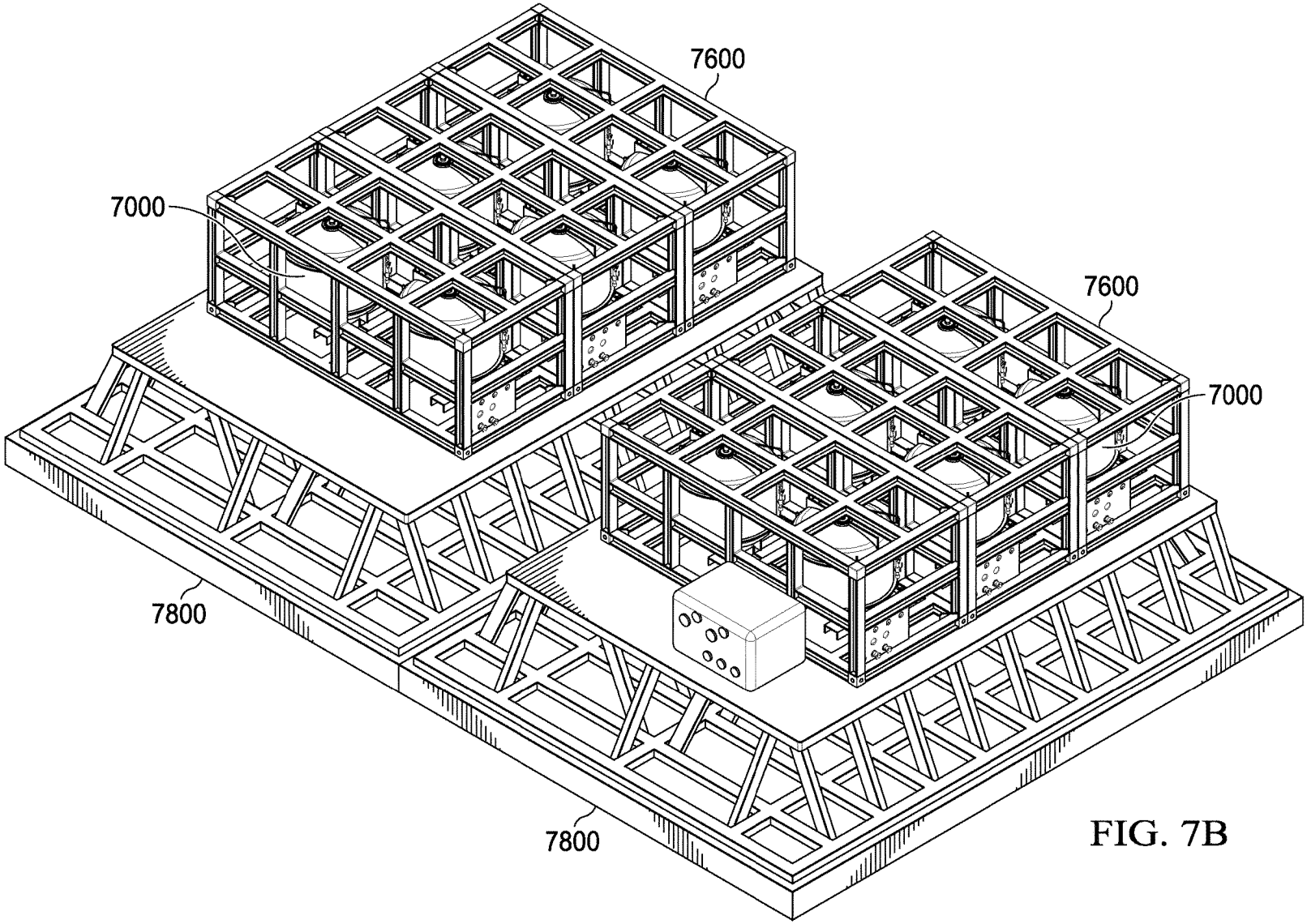
FIG. 7B illustrates a perspective view of a subsea fluid storage facility according to a specific example embodiment of the disclosure.

As previously descried, subsea fluid storage modules may be secured on or otherwise disposed on a subsea platform to form a subsea fluid storage system. As shown in FIG. 7A-7B, subsea fluid storage modules may comprise subsea fluid storage skids 7600 and subsea fluid storage units 7000 stored therein. Subsea fluid storage modules may then be disposed on or secured to subsea platforms 7800. A subsea fluid storage system may comprise a plurality of subsea platforms 7800 having a plurality of subsea fluid storage skids 7600 disposed thereon. In some embodiments, a tank farm may refer to a plurality of subsea platforms 7800 on which a plurality of subsea fluid storage modules are disposed. Accordingly, a subsea fluid storage system may comprise a plurality of subsea fluid storage units 7000 that may each be at varying levels of storage capacity and may house a variety (e.g., a wide variety) of chemicals therein. Each subsea fluid storage unit 7000 in a subsea fluid storage system may be individually drained and/or refilled. Each subsea fluid storage unit 7000 in a subsea fluid storage system may also be removed and/or replaced with another subsea fluid unit 7000 without disrupting overall operations of a subsea fluid storage system. The modular "plug-and-play" feature of the present disclosure may allow subsea fluid storage systems to be used or adapted for a wide variety of applications.

Further Embodiments

As will be understood by those of ordinary skilled in the art who have the benefit of the present disclosure, other equivalent or alternative devices, methods, and systems for subsea fluid storage systems can be envisioned without departing from the description contained herein. Accordingly, the manner of carrying out the disclosure as shown and described is to be construed as illustrative only.

One of ordinary skill in the art may make various changes in the shape, size, number, and/or arrangement of parts without departing from the scope of the instant disclosure. For example, the position and number of subsea fluid storage units within a subsea fluid storage module may be varied. In some embodiments, subsea fluid storage units within a subsea fluid storage module may be interchangeable. In addition, the size of a device and/or system may be scaled up or down to suit particular uses or applications. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a device and/or system for subsea fluid storage may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A subsea fluid storage unit with passive pressure compensation, the subsea fluid storage unit comprising:

a vessel, the vessel comprising a top port, a bottom port, and an internal vessel volume;

a deformable bladder disposed within the vessel, the bladder (i) comprising a first end and a second end, the second end having a bladder opening that is fluidically connected to the top port or the bottom port of the vessel, and (ii) defining an internal bladder volume;

a piston disposed within the vessel, adjacent to the first end of the bladder;

a first pressure relief valve at the top port; and a second pressure relief valve at the bottom port.

2. The subsea fluid storage unit of claim 1, wherein the piston is secured to the bladder, and wherein the position of the piston within the vessel varies as the internal bladder volume of the bladder varies.

3. The subsea fluid storage unit of claim 1, wherein the piston defines an upper chamber and lower chamber within the vessel.

4. The subsea fluid storage unit of claim 1 wherein the bottom port of the vessel is in fluid communication with the internal bladder volume, and wherein the top port is in fluid communication with ambient seawater.

5. The subsea fluid storage unit of claim 1, wherein the top port of the vessel is in fluid communication with the internal bladder volume, and wherein the bottom port is in fluid communication with ambient seawater.

6. A subsea fluid storage module, the subsea fluid storage module comprising:

a subsea fluid storage unit skid; and at least one subsea fluid storage unit disposed within the subsea fluid storage unit skid, wherein the fluid storage unit comprises:

a vessel, the vessel comprising a top port, a bottom port, and an internal vessel volume;

a deformable bladder disposed within the vessel, the bladder (i) comprising a first end and a second end, the second end having a bladder opening that is fluidically connected to the top port or the bottom port of the vessel, and (ii) defining an internal bladder volume a first pressure relief valve at the top port; and a second pressure relief valve at the bottom port.

7. The subsea fluid storage module of claim 6, the subsea fluid storage unit further comprising a piston disposed within the vessel, adjacent to the first end of the bladder.

8. The subsea fluid storage module of claim 7, wherein the piston is secured to the bladder, and wherein the position of the piston within the vessel varies as the internal bladder volume of the bladder varies.

9. The subsea fluid storage module of claim 7, wherein the piston defines an upper chamber and lower chamber within the vessel.

10. The subsea fluid storage module of claim 6, wherein the bottom port of the vessel is in fluid communication with the internal bladder volume, and wherein the top port is in fluid communication with ambient seawater.

11. The subsea fluid storage module of claim 6, wherein the top port of the vessel is in fluid communication with the internal bladder volume, and wherein the bottom port is in fluid communication with seawater.

12. The subsea fluid storage module of claim 6, wherein the subsea fluid storage unit skid is defined, at least in part, by a plurality of I-beam segments.

13. A subsea fluid storage facility, the subsea fluid storage facility comprising:

a subsea platform;

at least one subsea fluid storage unit skid disposed on the subsea platform; and at least one subsea fluid storage unit disposed within the subsea fluid storage unit skid, wherein the fluid storage unit comprises:

a vessel, the vessel comprising a top port, a bottom port, and an internal vessel volume; and a deformable bladder disposed within the vessel, the bladder (i) comprising a first end and a second end, the second end having a bladder opening that is fluidically connected to the top port or the bottom port of the vessel, and (ii) defining an internal bladder volume;

a first pressure relief valve at the top port; and a second pressure relief valve at the bottom port.

14. The subsea fluid storage facility of claim 13, the subsea fluid storage unit further comprising a piston disposed within the vessel, adjacent to the first end of the bladder.

15. The subsea fluid storage facility of claim 14, wherein the piston is secured to the bladder, and wherein the position of the piston within the vessel varies as the internal bladder volume of the bladder varies.

16. The subsea fluid storage facility of claim 14, wherein the piston defines an upper chamber and lower chamber within the vessel.

17. The subsea fluid storage facility of claim 13, wherein the bottom port of the vessel is in fluid communication with the internal bladder volume, and wherein the top port is in fluid communication with ambient seawater.

18. The subsea fluid storage facility of claim 13, wherein the top port of the vessel is in fluid communication with the internal bladder volume, and wherein the bottom port is in fluid communication with ambient seawater.

19. The subsea fluid storage facility of claim 13, the subsea fluid storage unit skid comprising a plurality of I-beam segments.

20. A method of operating a subsea fluid storage unit, the method comprising:

disposing a subsea fluid storage unit in a subsea environment, the subsea fluid storage unit comprising:

a vessel, the vessel comprising a top port, a bottom port, and an internal vessel volume;

a deformable bladder disposed within the vessel, the bladder (i) comprising a first end and a second end, the second end having a bladder opening that is fluidically connected to the top port or the bottom port of the vessel, and (ii) defining an internal bladder volume; and depositing a fluid within the bladder of the subsea fluid storage unit;

a piston disposed within the vessel, adjacent to the first end of the bladder;

a first pressure relief valve at the top port; and a second pressure relief valve at the bottom port.

21. The method of claim 20, wherein the piston defines an upper chamber and lower chamber within the vessel.

22. The method of claim 20, wherein the second end of the bladder is fluidically connected to the top port.

23. The method of claim 22, the method further comprising dispensing the fluid from the top port, whereby dispensing the fluid decreases the internal bladder volume.

24. The method of claim 22, the method further comprising receiving seawater from the bottom port, whereby receiving seawater expands the internal vessel volume.

25. The method of claim 20, wherein the second end of the bladder is fluidically connected to the bottom port.

26. The method of claim 25, the method further comprising dispensing the fluid from the bottom port, whereby dispensing the fluid decreases the internal bladder volume.

27. The method of claim 25, the method further comprising receiving seawater from the top port, whereby receiving seawater expands the internal vessel volume.

* * * * *